United States Patent [19]

Asselman et al.

[11] 3,965,334

[45] June 22, 1976

[54] HEATING DEVICE

[75] Inventors: George Albert Apolonia Asselman, Eindhoven, Netherlands; David Bruce Green, Weymouth, England; Adrianus Petrus Johannes Castelijns, Eindhoven, Netherlands; Pieter Aart Naastepad, Eindhoven, Netherlands; Jacob Willem De Ruiter, Eindhoven, Netherlands

[73] Assignee: U.S. Philips Corporation, New York, N.Y.

[22] Filed: Apr. 25, 1973

[21] Appl. No.: 354,498

[30] Foreign Application Priority Data

May 4, 1972 Netherlands ..... 7206063

[52] U.S. Cl. ..... 219/399; 13/1; 13/22; 165/105; 432/91; 219/406; 219/540

[51] Int. Cl. ..... H05b 3/62

[58] Field of Search ..... 165/105; 432/91; 219/326, 378, 399, 406, 530, 540; 13/1, 22

[56] References Cited

UNITED STATES PATENTS

| | | | |
|---|---|---|---|
| 628,052 | 7/1899 | Werner | 432/91 X |
| 1,084,439 | 1/1914 | Ihlee | 432/91 |
| 1,332,216 | 3/1920 | Hodge et al. | 432/91 |
| 3,640,517 | 4/1970 | Sendt | 165/105 X |
| 3,646,320 | 2/1972 | Rosatelli et al. | 165/105 X |
| 3,651,240 | 3/1972 | Kirkpatrick | 165/105 X |

FOREIGN PATENTS OR APPLICATIONS

| | | | |
|---|---|---|---|
| 852,231 | 1/1953 | Germany | 165/105 |

*Primary Examiner*—Albert W. Davis, Jr.
*Attorney, Agent, or Firm*—Frank R. Trifari

[57] ABSTRACT

A heating device, comprising a tubular body whose inner wall bounds a heating chamber for objects. Between the inner wall and the outer wall of this body a plurality of ducts is provided which are situated in a ring-shape about the heating chamber and which extend parallel to the tube axis. These ducts are separated from each other by rigid partitions. Each duct contains evaporable heat transport medium.

5 Claims, 31 Drawing Figures

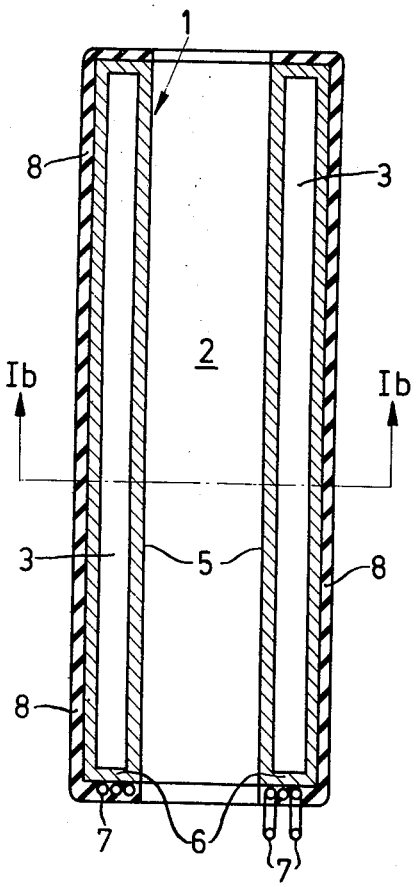
Fig.1a
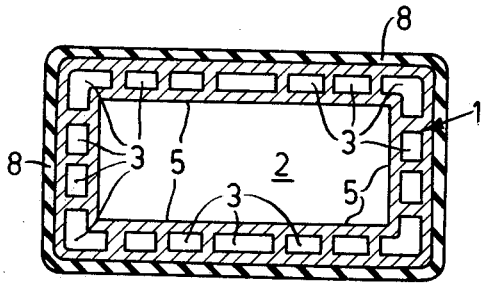
Fig.1b
Fig.1

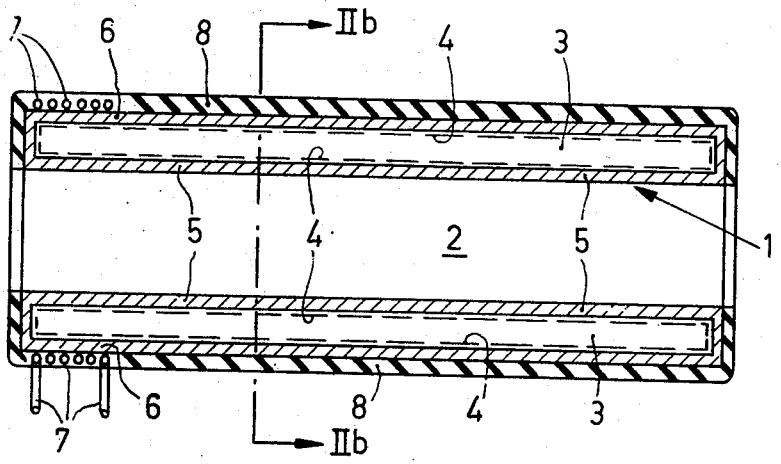
Fig.2a
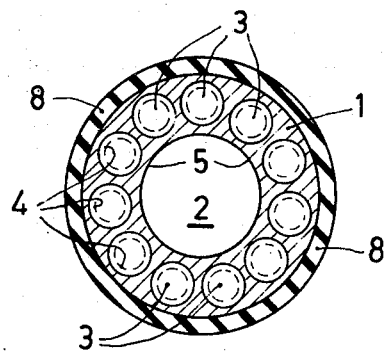
Fig.2b
Fig.2

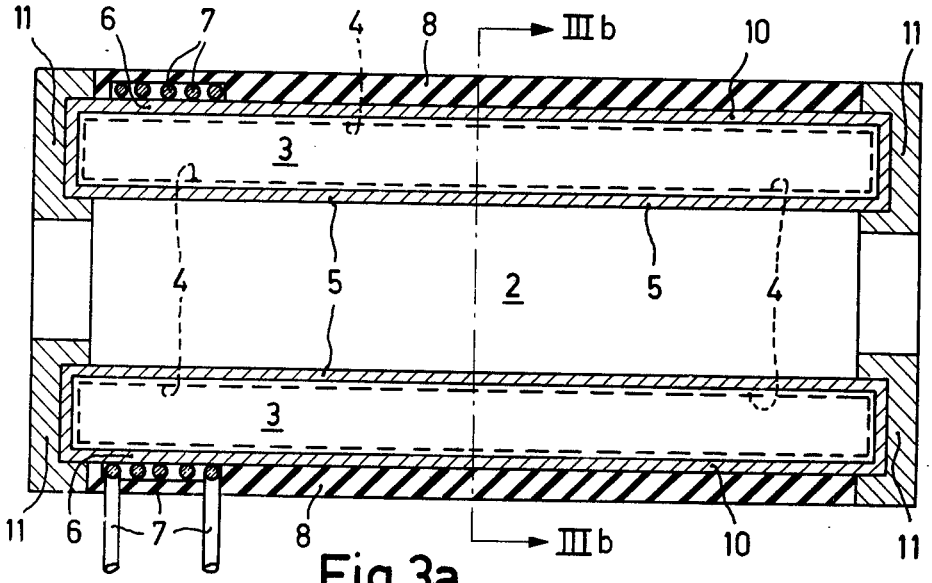
Fig.3a
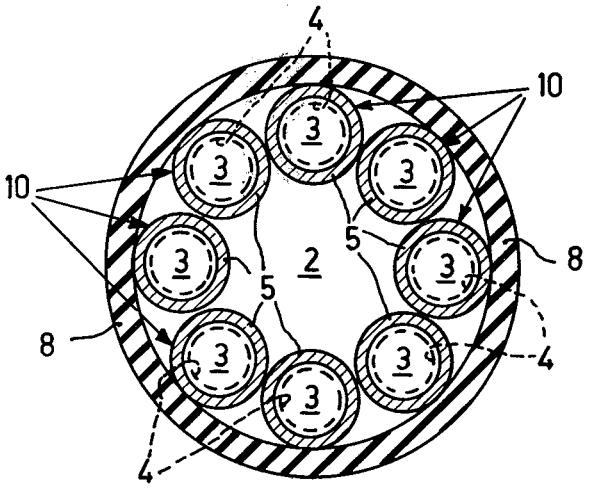
Fig.3b
Fig.3

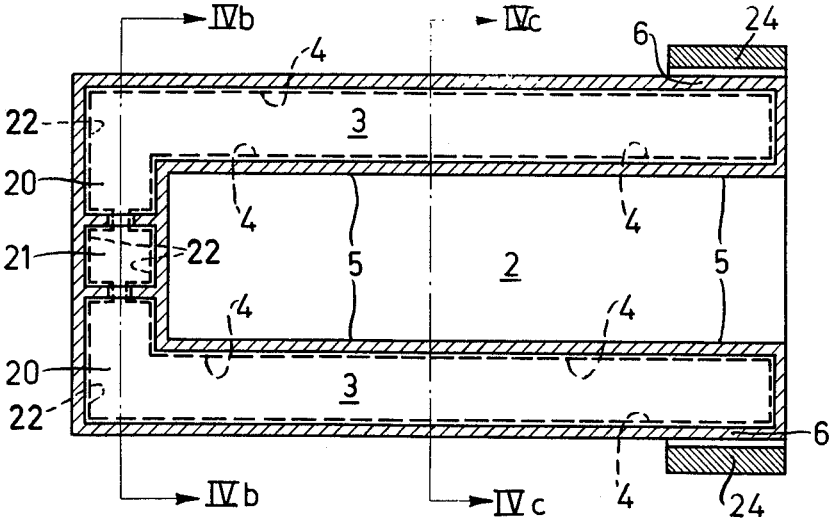
Fig.4a
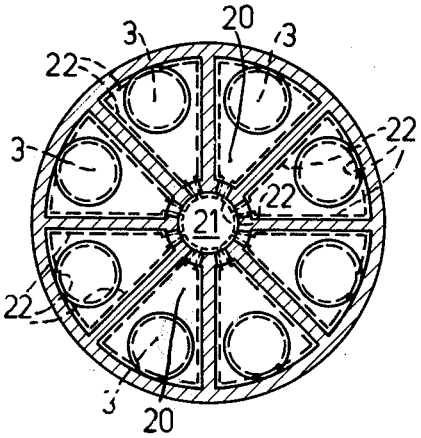
Fig.4b
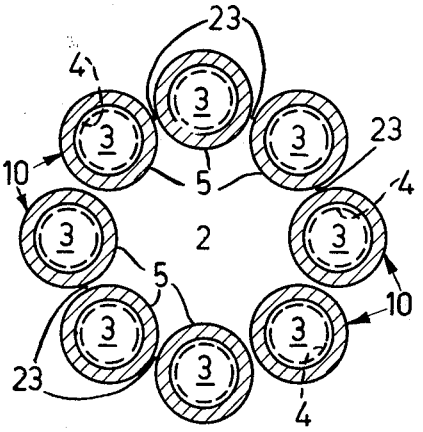
Fig.4c
Fig.4

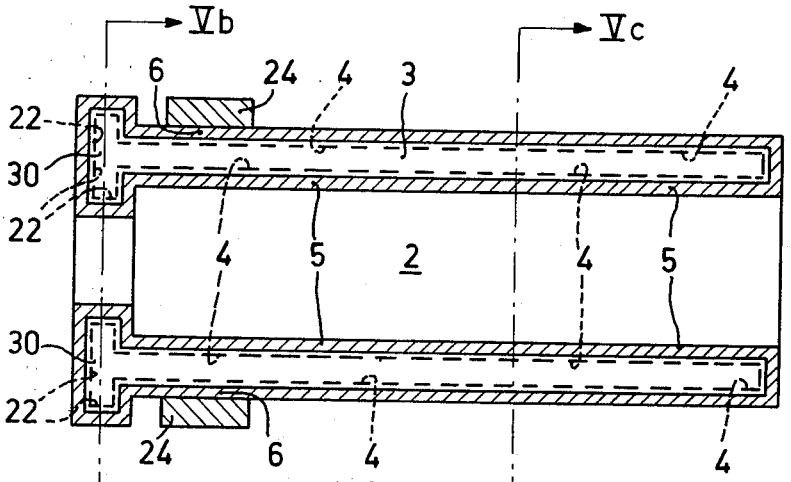
Fig.5a
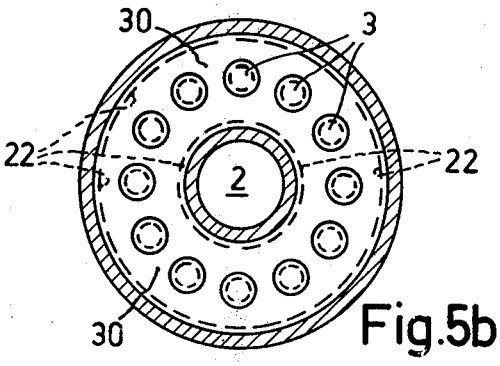
Fig.5b
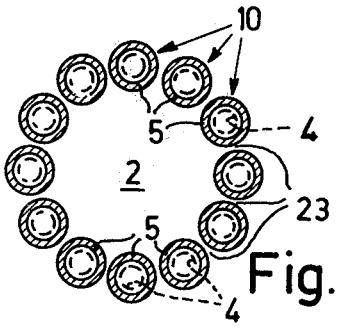
Fig.5c
Fig.5

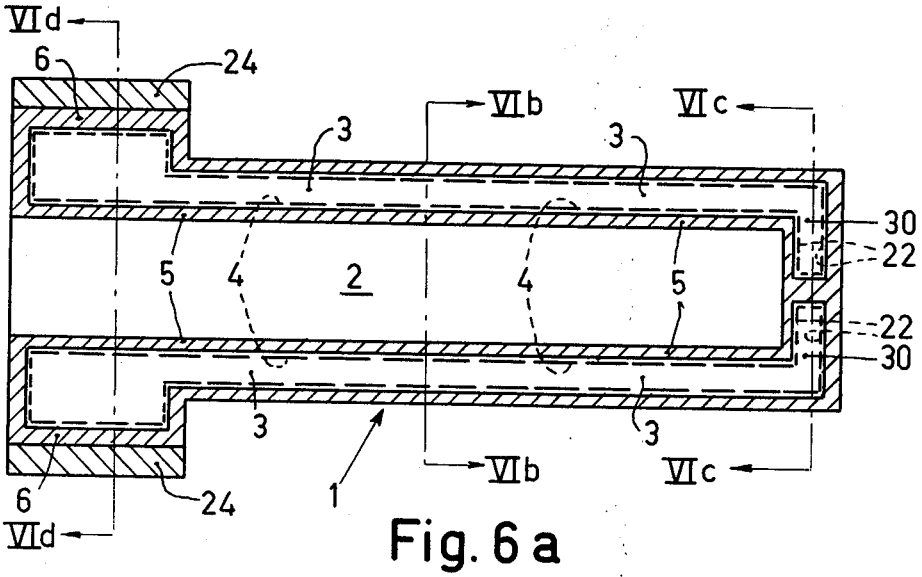
Fig. 6 a
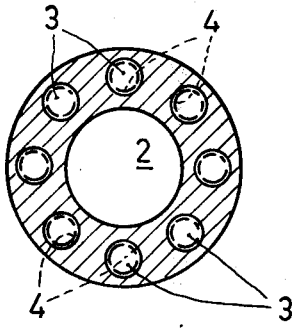
Fig. 6 b
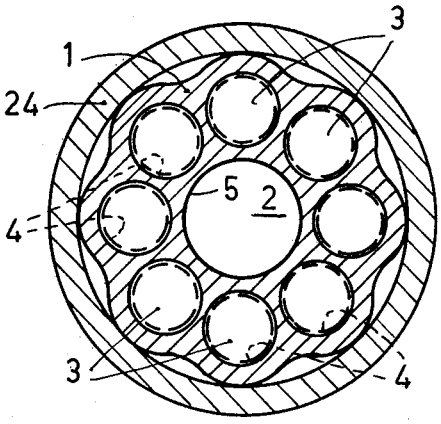
Fig. 6 d
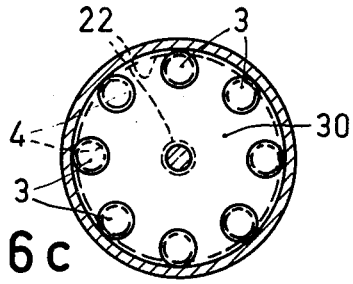
Fig. 6 c
Fig. 6

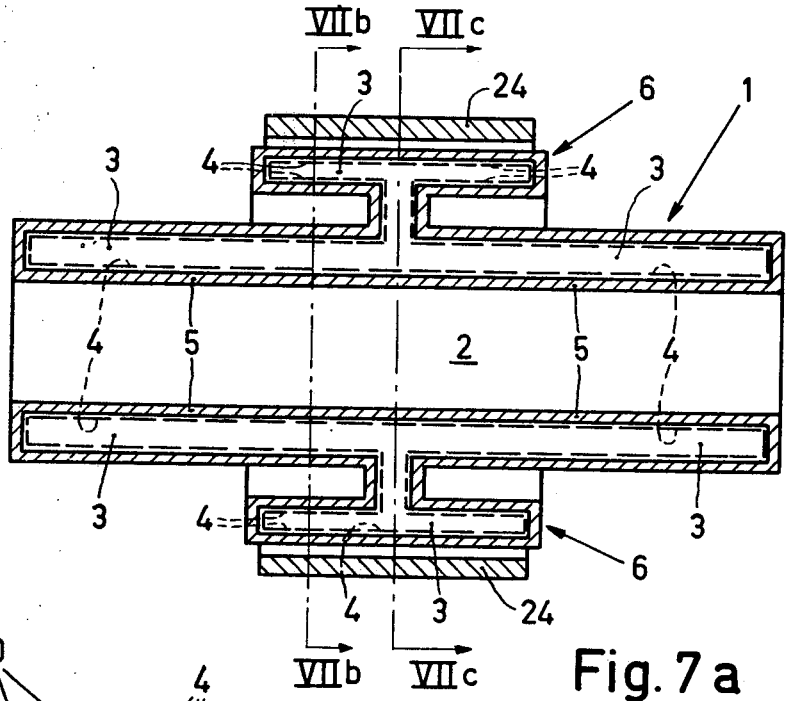
Fig. 7a
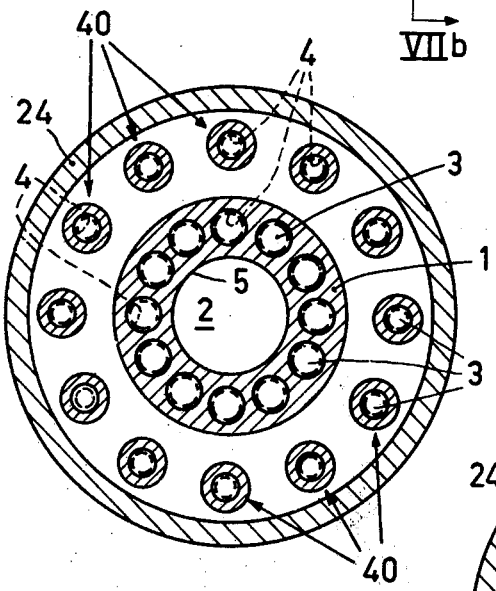
Fig 7b
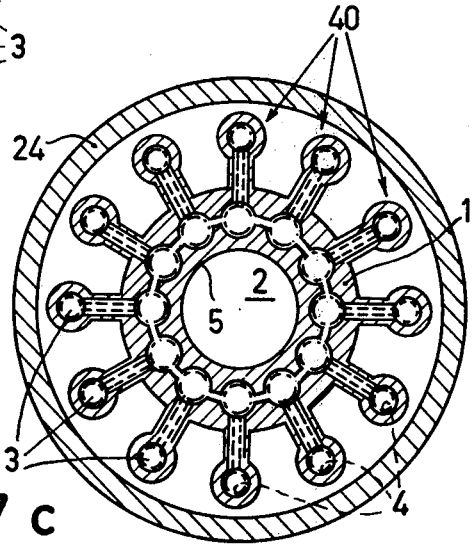
Fig. 7
Fig. 7 c

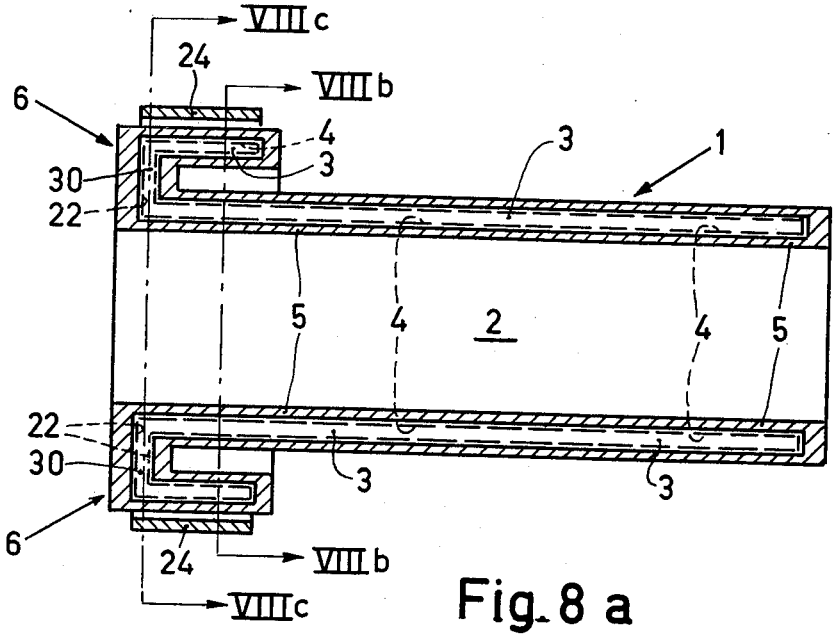
Fig. 8 a
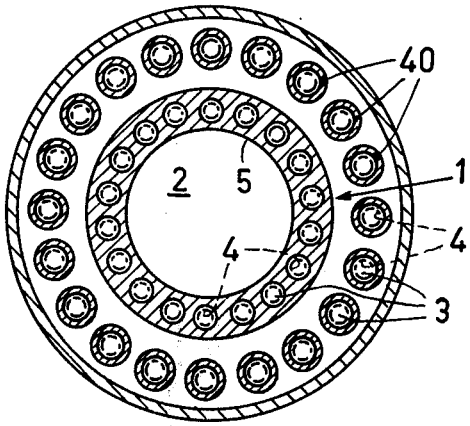
Fig. 8 b
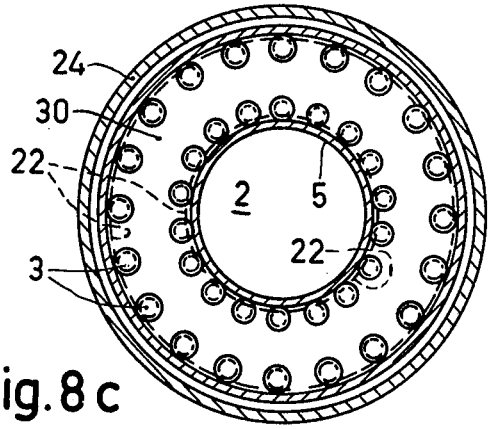
Fig. 8
Fig. 8 c

HEATING DEVICE

BACKGROUND OF THE INVENTION

The invention relates to a heating device, provided with an at least mainly tubular body, the inner wall of which bounds a heating chamber for objects, a closed space which surrounds the heating chamber being present between the inner wall and the outer wall of the body. The closed space is provided with an evaporator to which heat originating from a heat source can be applied, and with a condensor which is formed by the inner wall. An evaporable heat transport medium is present in the closed space and means are provided allowing heat transport medium condensate to flow back from the condensor to the evaporator.

A heating device of this kind is known from German Offenlegungsschrift 2, 131, 607. In the known device the tubular body consists of two concentrically arranged tubes which are arranged at some distance from each other and which constitute a closed, annular space in which heat transport medium and a capillary structure for the return of heat transport medium condensate from condensor to evaporator are situated. The annular space encloses the actual heating chamber. If desired, the return of condensate from condensor to evaporator can be effected exclusively by the force of gravity, i.e., without the capillary structure being present.

Liquid heat transport medium which evaporates at the area of the evaporator travels to the inner tube in the vapour state as a result of the lower vapour pressure which prevails at that area due to the comparatively low local temperature. Subsequently, the vapour condenses on the inner tube while transferring heat through the wall of this inner tube to the heating chamber, after which the condensate is returned through the capillary structure by capillary forces to the evaporator where it is evaporated again. Because the largest part of the vapour condenses always at the area on the inner tube where the lowest vapour pressure prevails, a locally lower temperature is immediately compensated for. Therefore, the inner tube has the same temperature everywhere.

The major advantage of this kind of heating device is that a fully isothermal heating chamber is obtained in a comparatively simple manner, which is of major importance notably in ovens. The heating device is, moreover, position-independent as condensate is returned from condensor to evaporator by the capillary structure in all circumstances. The choice of heat transport medium depends first of all on the desired operating temperature of the heating device. Potassium is particularly suitable for the temperature range 400°– 800°C, sodium for the range 600°– 900°C, and lithium for the range 950°– 1800°C.

A problem in the known heating device is the fact that for a chosen heat transport medium the temperature range within which the device can be operated is limited because the vapour pressure of the heat transport medium increases very strongly (exponentially) with the temperature. The walls of comparatively large dimensions which bound the annular space are then subjected to very high material stresses at higher temperatures. The wall material starts to fracture, the capillary structure is damaged and there is even a risk of explosions.

The material stresses in the inner and the outer tube are larger as the dimensions of the heating chamber are larger. This is because the said stresses are directly proportional to the diameter of the inner and the outer tube. Consequently, the dimensions of the heating device are also limited.

Furthermore, in heating devices for heating purposes above 950°C in which lithium is used as the transport medium, the fast corrosion of the wall material of the tubular body and the material of the capillary structure imposes a problem. This is because the available high-temperature wall materials (for example, wall material which is made of tantalum, or of niobium and zirconium alloys, or tungsten and rhenium alloys) and the capillary structure are attacked by the lithium due to the oxygen present in the system. The attack of the capillary structure blocks the return of condensate from the inner tube to the evaporator. The attack of the wall material leads to leakage, the released aggressive lithium then constituting a danger to the surroundings. The proper operation of the device is disturbed after a comparatively short period by these two types of attack.

The life of the device can be increased to some extent by making the wall material oxygen-free as much as possible at a high temperature in advance. However, this requires an expensive cleaning process. Sodium in combination with oxygen is much less aggressive than lithium in combination with oxygen. At operating temperatures below 950° C, a heating device in which sodium is used as the heat transport medium and chromium-nickel steel as the material for the walls and the capillary structure has a proper service life. At operating temperatures above 950° C, however, the vapour pressure of sodium strongly increases and the creeping strength of the steel decreases quickly. For example, the vapour pressure of sodium is approximately 7 atmospheres absolute at 1,150 °C. This again gives rise to the already described problems as regards fracturing etc.

SUMMARY OF THE INVENTION

The invention has for its object to provide a heating device of the kind set forth which is extremely suitable for operation in a large temperature traject, which has a long service life, which can have substantially any diameter and length, and which combines simplicity of construction with high operating safety.

So as to achieve this object, the heating device according to the invention is characterized in that the closed space is sub-divided into a plurality of ducts which extend at least mainly parallel to the tube axis and which are arranged in a ring-shape about the heating chamber. The ducts are separated from each other by rigid partitions, each duct containing heat transport medium and means being provided for allowing heat transport medium condensate to flow back from the relevant condensor part to the evaporator.

It is thus achieved that large diameters of the inner and the outer tube which form the boundary walls of the closed space are reduced to small diameters of ducts which extend in the longitudinal direction of the tubular body.

Due to the small duct diameters, a high loading of the walls of the ducts is possible without giving rise to large material stresses. This means, for example, that sodium or another low-corrosive fluid can be readily used as the heat transport medium under high vapour pressures.

The heating device according to the invention, therefore, can have a corrosion-resistant construction and be operated at high vapour pressures of the heat transport medium, without the risk of cracking in the wall or the risk of explosions. The heating device can thus be used on the one hand for a large range of operating temperatures, whilst on the other hand it has a long service life.

The heating device can be readily constructed and can have a variety of dimensions; it can notably have large dimensions because the material stresses in the walls of the ducts are no longer primarily dependent of the diametrical dimension of the tubular body. The tubular body can be constructed as an independent heating device, in particular as an isothermal oven. However, it is alternatively possible to insert the tubular body in existing heating devices. For example, the tubular body can be arranged in the oven space of a conventional oven (having, for example, electrical heating wires which are wound about the oven space) so as to render this oven space isothermal.

In a preferred embodiment of the heating device according to the invention the tubular body is made of a thick-walled solid piece of material and the ducts are formed by recesses in the piece of material. The heating device can thus be readily and inexpensively realized.

A further preferred embodiment of the heating device in which the tubular body has a circle-cylindrical shape is characterized in that the recesses in the material are bores of equal diameter, the distances between the centre lines of adjacent bores being equal and the bore centre lines being situated on a common circle.

In addition to the simplicity of manufacture, this rotationally-symmetrical embodiment offers the advantage that a uniform inner wall temperature is guaranteed, because all bores have the same heat transfer characteristics.

In a further preferred embodiment of the heating device according to the invention, the tubular body is composed of a number of hollow pipes which extend at least mainly parallel to the tube axis and which are arranged in a ring-shape about the heating chamber. The ducts are then formed by the pipe cavities. The pipes can adjoin each other so that a closed face is formed. However, narrow gaps can alternatively be present between the pipes without the isothermal character of the heating chamber being disturbed.

The pipes preferably have a circular cross-section and the same diameter and wall thickness. This can be advantageous for the manufacture on the one hand, and for a uniform distribution of the heat transfer over the circumference of the heating chamber on the other hand. In addition, round pipes offer the advantage that they produce a large outer-wall surface area of the tubular body. If this outer wall partly or completely constitutes the evaporator, a large quantity of heat can be transferred to the heat transport medium in the ducts at a comparatively low thermal load of the evaporator wall.

Pipes are also advantageous if the transfer of heat to the evaporator is effected by means of induction heating with high frequency or intermediate frequency generators. The induction current induced in the outer layer of a pipe (the so-termed skin-effect) can flow along a circular path over the pipe circumference, so that the entire pipe circumference is effectively used for the development of heat. In this case the presence of gaps between the individual pipes can be desirable or useful so as to maintain the circular current for each pipe.

In cases where the evaporator of the heating device is formed by a part of the outer wall of the tubular body, the temperature difference occurring between the part which is heated during operation and the part of the said body which is not heated can give rise to inadmissible material stresses in certain circumstances as a result of the difference in thermal expansion. This can notably be the case at high thermal loads of a heating device at a high operating temperature, such as can be realized with induction heating (more than 50 W/cm$^2$). In the latter case the induction heating can also cause the presence of an alternating electromagnetic field in the heating chamber, which may be objectionable, for example, because eddy currents are induced in the object to the treated.

In order to eliminate the said drawbacks, another preferred embodiment of the heating device according to the invention is characterized in that the ducts communicate with a number of further hollow pipes which constitute the evaporator and which are arranged in a ring-shape about the tubular body and which extend mainly parallel to the tube axis over a part of the axial dimension of this body.

The tubular body itself is now substantially no longer affected by the heating of the further hollow pipes which are situated thereabout and which together constitute the evaporator. By making the tubular body of a solid material or by assembling it from adjoining hollow pipes, there will be no alternating electromagnetic field in the heating chamber. Thus there will be no electrical current in the surface layer of the inner wall which faces the heating chamber.

Because the further hollow pipes have a diameter which is larger than the outer diameter of the tubular body, the evaporator formed by the further hollow pipes can have a large heat transfer surface area. The entire surface area of the further parts can then be used for the transfer of heat, not only in the case of induction heating but also, for example, in the case of gas-fired heating or heating by means of electrical resistance wires.

A preferred embodiment of the heating device according to the invention is characterized in that the ducts are in open communication with each other via connection ducts. The same vapour pressure of the heat transport medium then prevails in the ducts in all circumstances, and the temperature of the inner wall parts of the condensor will be the same, even if unequal quantities of heat were transferred to the ducts or discharged therefrom.

According to the invention, the connection ducts can accommodate a capillary structure for the transport of liquid heat transport medium which interconnects the ducts. This benefits the maintenance of a uniform distribution of heat transport medium between the various ducts.

In a preferred embodiment of the heating device according to the invention, the connection ducts form a common annular connection duct which extends transverse to the tube axis. The common annular connection duct is preferably situated at one end of the tubular body, the ducts opening directly into the annular duct. An annular duct can be comparatively, readily provided, in particular if this is effected in a plate which is to be arranged as the end plate of the tubular body.

During operation of the heating device, the entire inner wall as the condensor assumes a uniform temperature. However, in practice it may occur that this temperature varies in time. The temperature variations can be caused by fluctuations in the power supplied to the evaporator by the heat source, with the result that the vapour pressure of the heat transport medium in the ducts varies so that the condensation temperature also varies.

Due to the temperature variations of the isothermal inner wall, the object being subjected to thermal treatment in the heating chamber is also subjected to a variable temperature, which is undesirable in many cases. In order to stabilize the operating temperature of the heating chamber, a preferred embodiment of the heating device according to the invention is characterized in that the ducts are connected, via a central duct, to a gas buffer reservoir in which an inert control gas is present which, during operation forms an interface with heat transport medium vapour at the area of a heat-transmitting wall of the central duct; the control gas releases the heat-transmitting wall more or less when the heat transport medium vapour pressure becomes higher or lower, respectively, then the nominal value of this pressure corresponding to the nominal operating temperature of the condensor inner wall.

In the case of increased heat supply from the heat source to the evaporator, the vapour pressure of the heat transport medium in the ducts increases. As a result, the control gas is forced in the direction of the gas buffer reservoir and the vapour/control gas interface is also displaced in the said direction. The control gas thus releases a larger surface area of the heat-transmitting wall of the central duct, so that an increased discharge of heat to the surroundings takes place.

Conversely, if the supply of heat from the heat source decreases, the medium vapour pressure also decreases and the surface area of the heat-transmitting wall which is available for the discharge of heat is reduced by the control gas, so that less heat is discharged from the device.

If the gas buffer reservoir has a sufficiently large volume, the displacement of the interface exerts substantially no influence on the pressure level in this reservoir, so that this pressure remains substantially constant. It is thus achieved that the temperature of the inner wall is maintained at a constant value, in spite of fluctuations in the supply of heat to the evaporator. The control system utilizes the fact that a comparatively small temperature variation causes a comparatively large vapour pressure variation.

In an preferred embodiment of the heating device according to the invention, the control gas pressure in the gas buffer reservoir is adjustable. The temperature of the condensor inner wall can thus be readily and advantageously adjusted by controlling the boiling point of the heat transport medium by means of the control gas.

A further preferred embodiment of the heating device according to the invention is characterized in that the central duct and the gas buffer reservoir are provided with a second capillary structure which is connected to the ducts for the return of heat transport medium condensate from the reservoir to the ducts.

Consequently, the evaporation/condensation process of heat transport medium in the ducts cannot be disturbed by any medium shortage occurring, while the gas buffer reservoir can also be arranged in any position.

The invention will be described in detail with reference to the drawings in which a few embodiments of the heating device are diagrammatically shown, and not to scale.

BRIEF DESCRIPTION OF DRAWINGS

FIGS. 1 and 2 show heating devices which are made of a thick-walled solid piece of material.

FIG. 3 shows a heating device which is composed of a number of hollow pipes.

FIGS. 4, 5 and 6 show heating devices whose ducts, provided with a capillary structure and containing a heat transport medium, are in open communication with each other.

FIGS. 7 and 8 show heating devices having an evaporator which is arranged about the tubular body.

Figure 9:
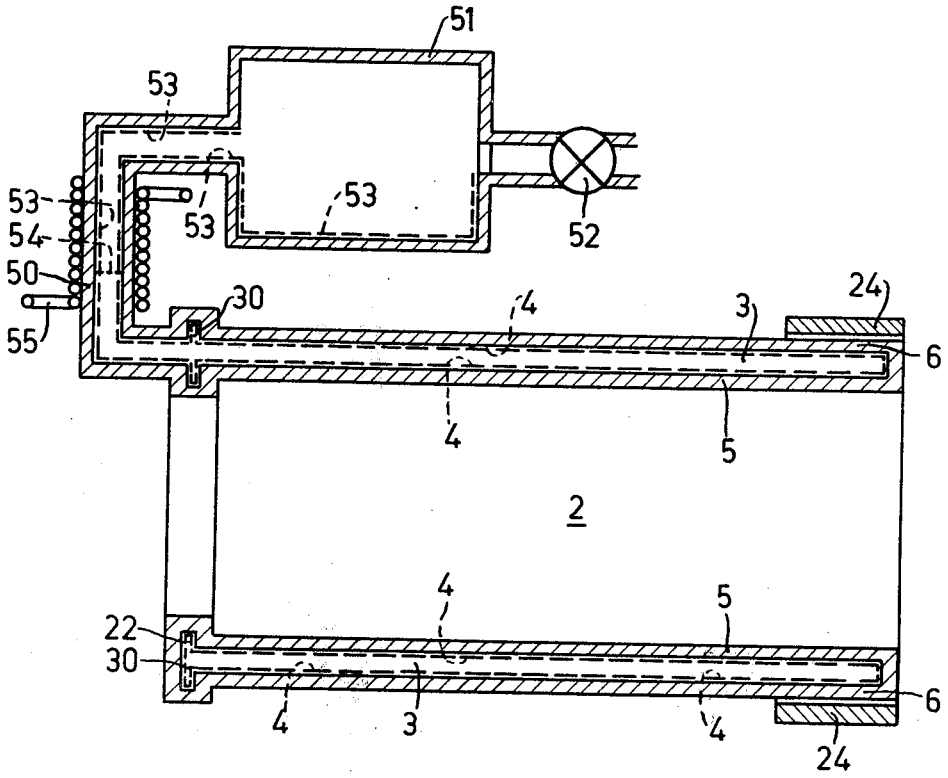

In the heating device shown in FIG. 9 the ducts communicate with a gas buffer reservoir.

DESCRIPTION OF THE PREFERRED EMBODIMENTS

The reference numeral 1 in FIG. 1 denotes a tubular body which consists of a thick-walled solid piece of chromium-nickel steel which envelops a heating chamber 2.

FIG. 1a is a longitudinal sectional view of the heating device, and FIG. 1b shows that the device has a rectangular section. Provided in the tubular body are a number of ducts 3 which are arranged about the heating chamber 2 and which extend parallel to the tube axis. Each of the ducts 3 contains a quantity of sodium as the heat transport medium.

The wall parts of the ducts 3 which bound the heating chamber 2 constitute a condensor 5. A cylinder end wall of the tubular body constitutes an evaporator 6. At the area of evaporator 6 an electrical heating wire 7 is provided as the heating source. The tubular body 1 is thermally insulated from the surroundings by means of a heat-insulating layer 8.

The operation of the heating device is as follows. The evaporator 6 is heated to a temperature of, for example, 1100° C by the electrical heating wire 7. Liquid sodium in the ducts 3 evaporates at the area of evaporator 6. The sodium vapour formed then flows to condensor 5 as a result of the lower vapour pressure at this area which is caused by a slightly lower local temperature. Subsequently, the sodium vapour condenses on condensor 5 while transferring heat thereto. This heat is transferred to heating chamber 2 through the wall of condensor 5. Sodium condensate is returned to evaporator 6 under the influence of the force of gravity, where it evaporates again. At the operating temperature of 1,100° C, the sodium vapour pressure is approximately 5 atmospheres. In view of the small diametrical dimensions of the duct 3, which may be as small as a few millimetres, there are no problems as regards the operating safety of the heating device, notably there is no risks of explosions. Should a leak occur in one of the ducts, the remaining ducts continue to operate as usual.

In spite of the high operating temperature, the heating device is corrosion-resistant, notably as a result of the choice of sodium as the heat transport medium and the use of chromium-nickel steel as the material for the tubular body.

This implies that the heating device has a simple construction and can be operated in a large temperature range, whilst it has a long service life and high operating safety.

The heating device shown is particularly suitable for use as a tunnel oven.

In the heating device shown in FIG. 2, for which the same reference numerals are used as for that shown in FIG. 1, the tubular body has a circle-cylindrical section (FIG. 2*b*).

Ducts 3 in this case consist of round bores of the same diameter and the same centre distances. The centre lines of the bores are situated on a common circle. This simple, rotationally-symmetrical heating device has a fully isothermal cylinder inner wall during operation. .

Evaporator 6 is now formed by a part of the outer wall of the tubular body. The electrical heating wire 7 is wound around this part.

A capillary structure 4 connects the condensor parts of the ducts 3 to evaporator 6. This capillary structure can be formed, for example, by grooves which extend in the wall in the axial direction, by a gauze layer, by a porous structure of ceramic material, by (glass) fibres etc., or by a combination thereof.

Sodium condensate is returned to evaporator 6 through capillary structure 4 on the basis of capillary forces. The operation of this heating device is for the remainder the same as that of the device shown in FIG. 1, so that a further description is not necessary.

FIG. 3 shows a heating device in which the tubular body is composed of a number of hollow, round pipes 10 which are arranged in a circle about the heating chamber 2, adjoin each other and are held at their ends in holders 11 of thermally insulating material. The other reference numerals correspond to those used for corresponding parts of the heating device shown in FIG. 2. The semi-cylindrical pipewalls which bound the heating chamber 2 together constitute, as a closed face, the condensor 5.

As a result of the pipe shape, the evaporator 6, formed by a part of the outer wall of the tubular body, has a large heat-transmitting surface area. In spite of a large heat input, the thermal loading of the evaporator wall remains comparatively low, which benefits the service life of the heating device.

The heating device shown in FIG. 4 is also composed of hollow pipes 10. The following differences exist with respect to the heating device according to FIG. 3. First of all, the ducts 3, formed by the pipe cavities, are in open communication with each other via connection ducts 20 and a common connection duct 21. This is shown in detail in FIG. 4*b*, which is a cross-sectional view taken at the area of the line IV*b*—IV*b* of FIG. 4*a*. It is thus achieved that the same sodium vapour pressure prevails in all ducts, so that in all pipes 10 condensation takes place at the same temperature. The influence of any irregular supply of heat to or discharge of heat from the various pipes is thus fully eliminated, and the isothermal character of the complete condensor 5 is always ensured.

The connection ducts 20 and the common connection duct 21 are provided with a capillary structure 22 which interconnects the capillary structure 4 of the ducts 3 and which ensures that the sodium condensate does not remain in the connection ducts and that all ducts have always sodium available.

Furthermore, narrow gaps 23 are provided between the pipes (FIG. 4*c*), and a high-frequency induction coil 24 which is wound about the open end of the tubular body serves as a heat source.

During operation, coil 24 induces electrical currents in the outer surface layers of the pipes 23. For each pipe this current follows a circular path over the pipe circumference (circular current). This offers the advantage that the entire pipe circumference is utilized for heat development. The gaps 23 ensure that the circular currents are maintained. If the pipes were to adjoin, it could be possible that only one circular current appears through the outer surface layer of the tubular body, so that only the outer wall parts of the pipes would be used for the development of heat.

The heating device shown in FIG. 5 is substantially the same as that shown in FIG. 4. The same reference numerals are used for corresponding parts. In this case the connection ducts constitute a common connection ring duct 30 which extends transverse to the tube axis and which is situated on one tube end so that all ducts 3 open therein. This is shown in detail in FIG. 5*b*, which is a sectional view of FIG. 5*a* taken at the area of the line V*b*—V*b*. From a construction point of view, this is a very attractive and simple solution. The pipes 23 can be mounted, for example, on an end plate in which the connection ring duct is provided. If desired, the heating device can also be provided with a connection ring duct on its other end.

FIG. 6 shows a heating device in which the tubular body 1 consists, like that in the device shown in FIG. 2, of a circle-cylindrical piece of solid material provided with bores (FIG. 6*b*). The present device is closed on one end. In the closed end the connection ring duct 30 with the capillary structure 22 (FIG. 6*c*) is provided.

The tubular body has an outer diameter which is locally larger at its open end. About this part having the larger diameter the high frequency induction coil 24 is wound. The larger diameter produces a larger heat-transmitting surface area for evaporator 6, and hence comparatively low thermal loading of the evaporator wall. Because the outer surface is corrugated, the heat-transmitting surface area is additionally increased (FIG. 6*d*).

The heating device shown in FIG. 7 again has a tubular body 1 which is made of a solid material. Halfway this body, the ducts 3 communicate with a number of hollow pipes 40 which are arranged in a ring about the tubular body, parallel to the tube axis. The walls of the hollow pipes 40 together constitute the evaporator 6. The supply of heat to the evaporator is again effected by induction heating by means of the high frequency induction coil 24. This construction offers some additional advantages. As the heat is not supplied directly to the tubular body but to an evaporator which is situated at some distance therefrom, no material stresses occur in the tubular body due to temperature differences between a heated part and a non-heated part of this body. The entire wall surface area of each hollow pipe 40 is available for heat transfer or induction heating, respectively. The total heat-transmitting surface area is, therefore, very large so that high powers can be transferred at low wall loads.

The tubular body 1 shields the heating chamber 2 from the coil 24. No induction current can be generated in the surface layer of the inner wall of the tubular body. Consequently, the heating chamber is free from alternating electromagnetic fields.

The heating device shown in FIG. 8 differs from that shown in FIG. 7 only in that in this case the hollow pipes 40 are situated on one end of the tubular body, the ducts 3 also being in open communication with each other on this end via the connection ring duct 30 with the capillary structure 22, like in the device shown in FIG. 5.

FIG. 9 shows a heating device in which the ducts 3 in the tubular body (made of solid material or of hollow pipes) communicate at the area of connection ring duct 30, via a central duct 50, with a gas buffer reservoir 51 which is provided with a valve 52. A capillary structure 53 which is connected, via capillary structure 22 in connection duct 30, to capillary structure 4 in the ducts 3 extends in the central duct 50 as far as reservoir 51. The wall of central duct 50 is heat-transmitting.

The gas buffer reservoir contains argon as the inert control gas.

During operation, when heat is supplied to evaporator 6 by means of induction coil 24, this control gas forms an interface with the sodium vapour, for example, at the area 54.

If for some reason a quantity of heat is supplied to the device, notably to evaporator 6, which is larger than the nominal quantity which corresponds to the nominal temperature of condensor 5, the sodium vapour pressure increases and the interface is displaced in the direction of the gas buffer reservoir 51 as a result of the increased vapour pressure. The control gas then releases a larger surface area of central duct 50 with the result that the quantity of heat which exceeds the nominal quantity is transferred to the surroundings through the wall of the central duct.

Vapour pressure increases exceeding the nominal vapour pressure are thus eliminated. The condensation temperature and hence the temperature of the isothermal inner wall 5 then remain constant.

If the quantity of heat supplied decreases below the nominal value, the sodium vapour pressure decreases, with the result that the interface is displaced in the downward direction, i.e., in the direction of connection ring duct 30. The control gas then shields a larger part of the wall surface of central duct 50 so that less heat can flow to the surroundings and the sodium vapour pressure is maintained at substantially the nominal value. Also in this case the isothermal inner wall 5 remains at the same temperature.

In this simple manner it is achieved that the isothermal inner wall 5 always remains at the same constant temperature, in spite of variations in the supply of heat. Gas buffer reservoir 51 has a sufficiently large volume to ensure that the displacements of the interface do not cause a variation of the pressure level in this reservoir. Capillary structure 53 ensures that the heating device remains position-independent. Should liquid sodium penetrate into gas buffer reservoir 51, it will be returned to the ducts 3 via capillary structure 53. Thus no sodium shortage can arise in these ducts.

Via valve 52, argon can be supplied under different pressures to gas buffer reservoir 51. A higher argon pressure results in a higher boiling point, a lower argon pressure results in a lower boiling point of the sodium. The isothermal inner wall 5 can thus be adjusted to a given desired temperature. In addition to the maintenance of a constant temperature, the level of this temperature can thus also be adjusted. As is shown in the drawing, a cooling coil 55 through which a cooling medium, for example, water, can flow can be wound about central duct 50. By controlling the cooling medium flow, the temperature of the central duct can be maintained at a given value and the effect of ambient temperature variations can be eliminated.

What is claimed is:

1. A heating device comprising a housing formed as a round tube made of heat insulating material, the tube having an inner peripheral surface and first and second ends, a plurality of heat pipes, each being a hermetrically sealed tube with a first evaporation end, a second condensation end, and capillary material on the inner peripheral surface, said heat pipes situated around and adjacent said housing inner peripheral surface and positioned in parallel with each other and with said housing tube axis, said heat pipes positioned with their first and second ends respectively adjacent said first and second ends of said housing, and at each end of the housing an annular end plate of heat insulating material, secured to and maintaining in relative position said heat pipes and housing tube ends, with a cylindrical heating chamber defined by the space radially inward of said heat pipes.

2. Apparatus according to claim 1 wherein said heat pipes contain potassium as the heat transport medium, for operation in the temperature range of 400–800°C.

3. Apparatus according to claim 1 wherein said heat pipes contain lithium as the heat transport medium, for operation in the temperature range of 950°–1800°C.

4. Apparatus according to claim 1 wherein said heat pipes contain sodium as the heat transport medium for operation in the temperature range of 600°–900°C.

5. Apparatus according to claim 1 operable with a source of electric current, further comprising wire heating elements wound around the housing inner periphery and adjacent the evaporation ends of said heat pipes.

* * * * *